US007850277B2

(12) United States Patent
Morris et al.

(10) Patent No.: US 7,850,277 B2
(45) Date of Patent: Dec. 14, 2010

(54) INTEGRATED MAINTENANCE AND PAPER PICK SYSTEM

(75) Inventors: Edward Michael Morris, Lexington, KY (US); William Michael Connors, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 858 days.

(21) Appl. No.: 11/676,544

(22) Filed: Feb. 20, 2007

(65) Prior Publication Data

US 2008/0198197 A1 Aug. 21, 2008

(51) Int. Cl.
*B41J 2/165* (2006.01)

(52) U.S. Cl. ..... 347/29; 347/32; 347/33

(58) Field of Classification Search ..... 347/29, 347/32, 33, 35, 36
See application file for complete search history.

(56) References Cited

U.S. PATENT DOCUMENTS 6,561,618 B1 * 5/2003 Simmons et al. ..... 347/32
6,588,876 B2 * 7/2003 Taylor et al. ..... 347/32

* cited by examiner

*Primary Examiner*—Shih-wen Hsieh
(74) *Attorney, Agent, or Firm*—John Victor Pezdek

(57) ABSTRACT

A printhead maintenance station comprises a base including a spitting zone, a maintenance sled movable relative to the base, a wiper assembly for cleaning a printhead orifice plate, a capping assembly for capping a printhead orifice plate, a pick motor operating a paper picking assembly and the maintenance sled and the capping assembly, and, wherein the maintenance station provides for spitting, wiping, and capping of a printhead orifice plate.

21 Claims, 12 Drawing Sheets

INTEGRATED MAINTENANCE AND PAPER PICK SYSTEM

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates to ink jet printing mechanisms. More particularly, the present invention relates to an integrated ink jet maintenance and paper pick system.

2. Description of the Related Art

All-in-one machines typically perform functions such as printing, scanning, copying, and faxing in either a stand alone fashion or in conjunction with a personal computer and define a growing market for peripheral devices. These devices eliminate clutter in a business or home office by combining the desirable functionality of various machines into a single unit, while maintaining an affordable cost. Various all-in-one machines currently in the marketplace use thermal inkjet technology as a means for printing received fax documents, original documents, and copied or scanned images or text.

Thermal inkjet printing devices, as part of all-in-one or multi-function peripherals, utilize consumable inkjet cartridges in fluid communication with a printhead to record text and images on a print media. The printhead typically moves on a carriage relative to the media path and a control system activates the printhead to selectively eject ink droplets onto the print media. A heater chip heats the printhead causing selective ejection of ink for printing an image, such as text, photo, line art or some combination thereof.

Various ink jet print systems utilize a maintenance or service station which includes a wiper mechanism for wiping away particles accumulated on the printhead orifice plate, and a receptacle or spittoon into which the printhead periodically fires to purge dried or plugged nozzles. The spittoon collects ink droplets sprayed from the printhead during the clearing process. The service station may also include a mechanism to cap the printhead nozzles when the pen is not printing. Typically, the cap mechanism encloses the exposed outer surface of the orifice plate defining the nozzle array, to help prevent drying of the ink at the nozzles, and prevent contamination with dust.

In prior art ink jet printers having the above discussed technology, the wiping action is typically "east/west" wiping. The term east/west is not to be understood as literal but merely a designation of directional movement along one axis within a printer. Such east/west motion utilizes the existing motion of a print carriage within an ink jet printer to maintain the orifice plate of the printhead.

In new designs, the printhead heater chips require that the orientation of printhead wiping occur in a perpendicular "north/south" direction. Again, the term north/south should not be taken literally, but instead should be understood as a direction which is generally perpendicular to the printhead operating motion previously described as east/west. This design should also provide a capping function as well as allow for spitting of the printhead.

As with many printing devices, efficiency is an important parameter for performance. The media throughput is an important measure of efficiency. The addition of a pick motor, separate of the feed motor, is known to increase efficiency. However, additional motors cause increased manufacturing cost which is undesirable. Therefore it is preferable to utilize an existing motor to operate the maintenance system.

What is needed is a maintenance system which allows for the wiping maintenance function to be performed in a preselected direction of movement. It is also preferable that the maintenance system be driven by a motor which also drives the media picking system.

SUMMARY OF THE INVENTION

A printhead maintenance station for a printer having a print carriage movable along a first axis including at least one print cartridge, the print cartridge having a printhead, comprises a printhead maintenance sled movable along a second axis perpendicular to the first axis, a lifting assembly having a cap which may be moved from the sled along a third axis, a motor driving a media picking assembly and the printhead maintenance station. The printhead maintenance station further comprises a wiping assembly attached to the sled and movable along the second axis. The printhead maintenance station further comprises a sled drive assembly driving said sled and the capping and wiping assemblies. The sled drive assembly further comprises a base rack. The base rack has a cam follower engaged by a cam. The printhead maintenance station further comprises a biasing element connected to the base rack. The printhead maintenance station further comprises at least one cam cap lift biased by the biasing element. The at least one cam cap lift is a monochrome cam cap lift and a color cam cap lift. The printhead maintenance station further comprises a pinion gear engaging said base rack, wherein said base rack and pinion drive said sled along said second axis. The motor drives a cam, the cam engages a cam follower on the base rack to operate the maintenance station.

A printhead maintenance station comprises a base including a spitting zone, a maintenance sled movable relative to the base, a wiper assembly for cleaning a printhead orifice plate, a capping assembly for capping a printhead orifice plate, a pick motor operating a paper picking assembly and the maintenance sled and the capping assembly, and, wherein the maintenance station provides for spitting, wiping, and capping of a printhead orifice plate. The printhead operating motion is transverse to a media feed direction and the maintenance sled moves in the media feed direction. The maintenance sled is movable to reveal the spitting zone. The printhead orifice plate moves in an east-west orientation and the maintenance sled moves in a north-south orientation. The maintenance sled moves the wiper assembly in a direction which is perpendicular to the motion of the printhead orifice plate.

A print device maintenance station comprises a maintenance sled. The maintenance sled has a capping assembly and a wiper, wherein the maintenance station converts a first rotary input motion to a first linear motion, the first linear motion to a second rotary motion, and the second rotary motion to a second linear motion to move the maintenance sled. The print device maintenance station further comprises a cam cap lift engaging a capping assembly. The sled moves from a spitting zone to a capping zone. The print device maintenance station wherein the maintenance sled moves along an axis which is perpendicular to an axis of movement of a print cartridge. The print device maintenance station further comprises a media pick assembly wherein a pick motor operates the media pick assembly and the maintenance station. In the print device maintenance station, the first rotary input causes movement of the maintenance sled and movement of a capping assembly.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
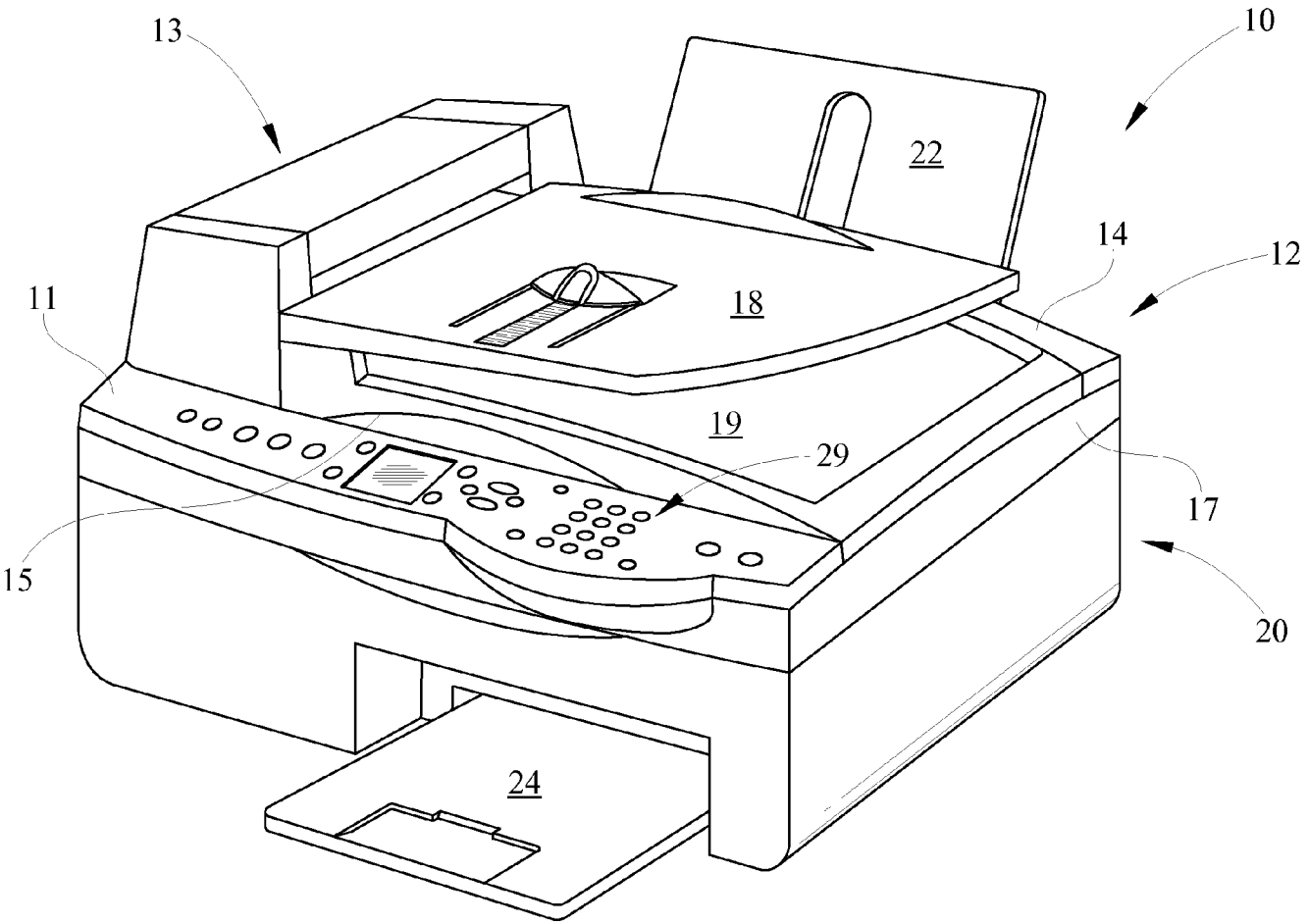
FIG. 1 is a perspective view of an exemplary peripheral device with L-shaped media feed path.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that embodiments of the invention include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible.

The term image as used herein encompasses any printed or digital form of text, graphic, or combination thereof. The term output as used herein encompasses output from any printing device such as color and black-and-white copiers, color and black-and-white printers, and so-called "all-in-one devices" that incorporate multiple functions such as scanning, copying, and printing capabilities in one device. Such printing devices may utilize ink jet, dot matrix, dye sublimation, laser, and any other suitable print formats. The term button as used herein means any component, whether a physical component or graphic user interface icon, that is engaged to initiate output.

Referring initially to FIG. 1, an all-in-one or multi-function peripheral device 10 is shown having an upper scanner portion 12 and a lower printer portion 20, depicted generally by the housing. The multi-function peripheral device 10 is shown and described herein, however one of ordinary skill in the art will understand upon reading of the instant specification that the present invention may be utilized with a stand alone printer, copier, scanner or other peripheral device utilizing a media feed system. The peripheral device 10 further comprises a control panel 11 having a plurality of buttons 29 for making command selections or correction of error conditions. The control panel 11 may include a graphics display to provide a user with menus, choices or errors occurring with the system.

The printer portion 20 includes two media trays for media throughput. Extending from the rear of the printer portion 20 is an input tray 22 for retaining media prior to printing. Extending from the front of the printer portion 20 is an output tray 24 for retaining media after a print process. The input and output trays 22, 24 of the printer portion 20 define start and end positions of a media feedpath 21 (FIG. 2) within the printer portion 20. The media trays 22, 24 each retain a preselected number of sheets defining a stack of media (not shown) which will vary in thickness based on the media type. One skilled in the art will understand that the media feedpath 21 illustrated is an L-shaped media feedpath due to the depicted configuration. However, it is within the scope of the present invention that the integrated maintenance and media pick system may be used in a C-shaped media feedpath configuration.

Figure 2:
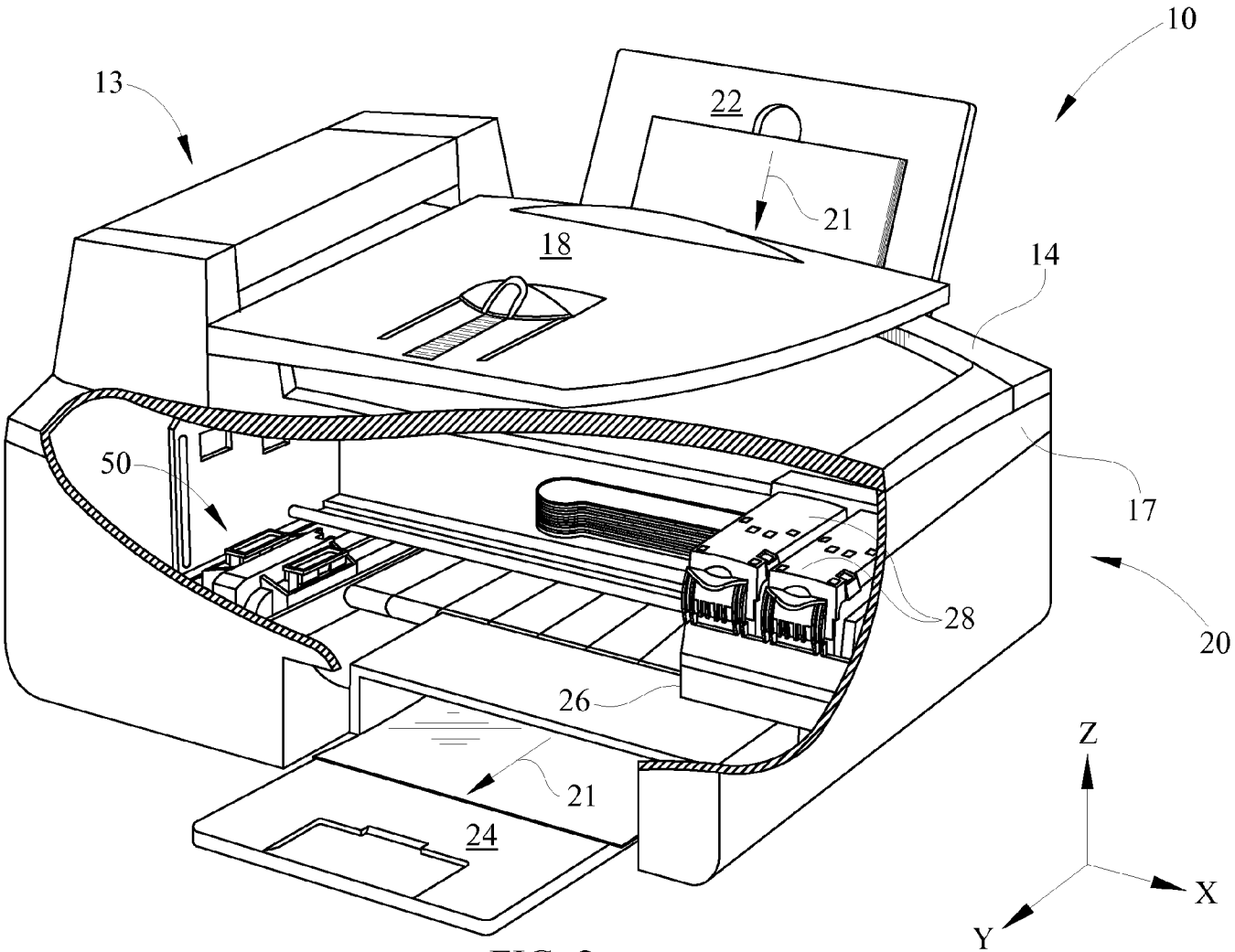
FIG. 2 is a cut-away perspective view of the interior of the peripheral device of FIG. 1 depicting the carriage and ink cartridges.

Referring now to FIG. 2, an interior cut-away perspective view of the all-in-one device 10 is depicted. For clarity, much of the interior of the printer portion 20 is removed. The printer portion 20 may include various types of printing mechanisms including dye-sublimation, ink-jet or laser printing. For ease of description, the exemplary printer portion 20 may be an inkjet printing device although such description should not be considered limiting. With the interior of the exemplary embodiment shown, the printing portion 20 includes a carriage 26 having a position for placement of at least one print cartridge 28. FIG. 2 depicts two print cartridges 28 which may be, for instance, a color cartridge for photos and a black cartridge for text or other monochrome printing. As one skilled in the art will recognize, the color cartridge may include three inks, i.e., cyan, magenta and yellow inks. Alternatively, in lower cost machines, a single cartridge may be utilized wherein the three inks, i.e., cyan, magenta and yellow inks are simultaneously utilized to provide the black for text printing or for photo printing. As a further alternative, a single black color cartridge may be used. During advancement media moves from the input tray 22 to the output tray 24 in a substantially L-shaped path along the media feedpath 21 beneath the carriage 26 and cartridges 28. As the media M moves into a printing zone, beneath the at least one ink cartridge, the media M moves in a first Y-direction (North-South) and the carriage 26 and the cartridges 28 move in a second X-direction (East-West) which is transverse to the movement of the media M. During this movement, ink is selectively ejected onto the media to form an image. The figure also depicts the maintenance station 50 at the opposite end of the travel path from the depicted position of carriage 26 and cartridges 28.

Referring again to FIG. 1, the scanner portion 12 generally includes an ADF scanner 13, a scanner bed 17 and a lid 14 which is hingedly connected to the scanner bed 17. Beneath the lid 14 and within the scanner bed 17 may be a transparent platen (not shown) for placement and support of target or original documents for manually scanning. Along a front edge of the lid 14 is a handle 15 for opening of the lid 14 and placement of the target document on the transparent platen (not shown). Adjacent the lid 14 is an exemplary duplexing ADF scanner 13 which automatically feeds and scans stacks of documents which are normally sized, e.g. letter, legal, or A4, and suited for automatic feeding. Above the lid 14 and adjacent an opening in the ADF scanner 13 is an ADF input tray 18 which supports a stack of target media or documents for feeding through the auto-document feeder 13. Beneath the input tray 18, the upper surface of the lid 14 also functions as an output tray 19 for receiving documents fed through the ADF scanner 13.

Figure 3:
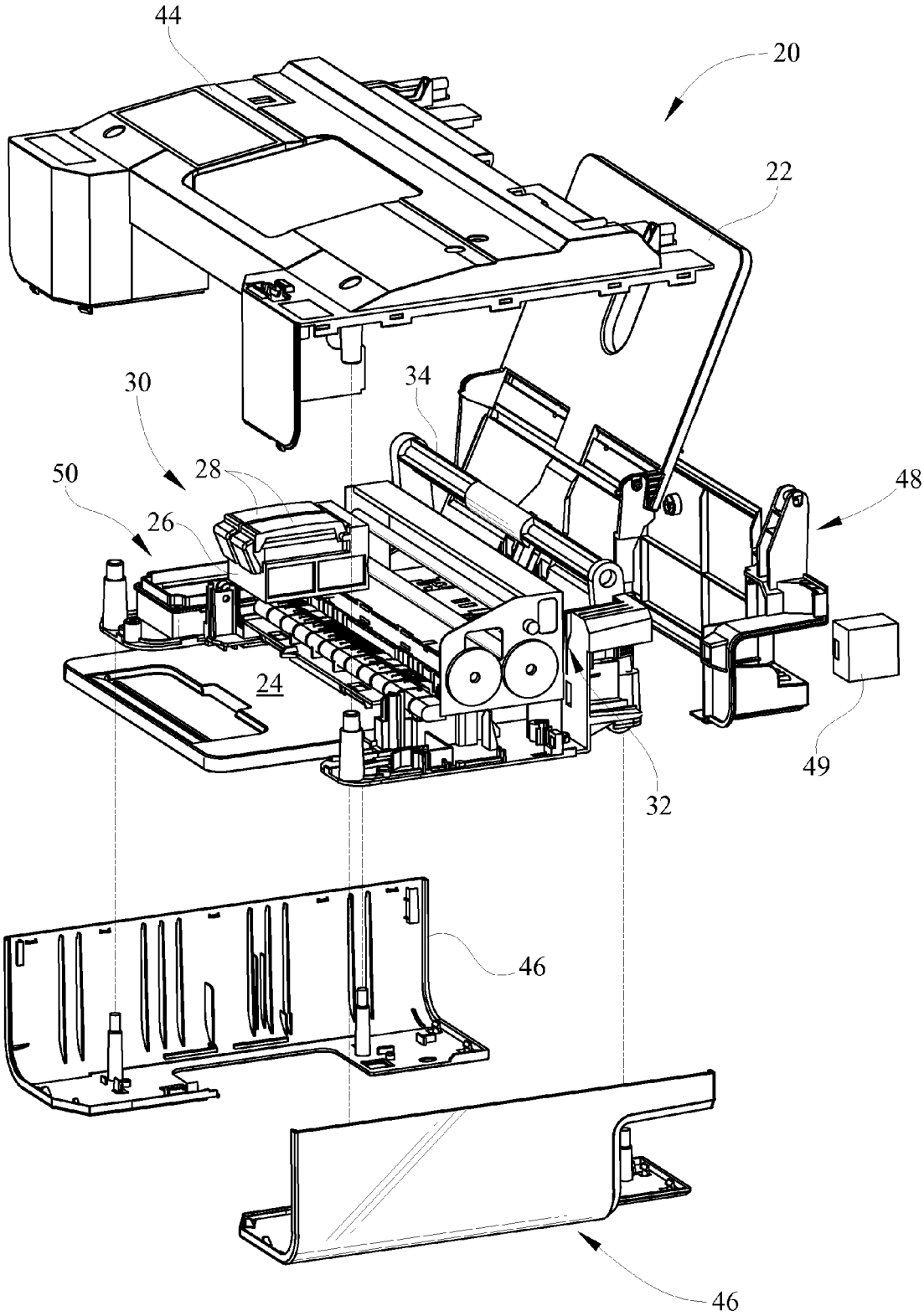
FIG. 3 is an exploded perspective view of interior portions of the printer portion of FIGS. 1 and 2.

Referring now to FIG. 3, an exploded perspective view of the interior portions of the printer portion 20 is depicted. The printer portion 20 comprises a universal base 30. The base 30 includes the feed path 21 (FIG. 2) disposed between the input tray 22 and the output tray 24 as well as a mid-frame 32 disposed along the feed path 21. Adjacent the mid-frame 32 and above the feed path 21 is the print carriage 26 wherein two print cartridges 28 are disposed. Adjacent the mid-frame 32 is a center feed pick system 34 which is movable toward and away from the input tray 22 in order to feed media along the feed path 21. The base 30 also comprises the maintenance station 50 at one end near an end of the print carriage 26 travel path. The carriage 26 and cartridges 28 are shown in a position opposite that shown in FIG. 2.

Above the universal base 30 is a base cover 44 upon which the scanner portion 12 may be positioned. Beneath the universal base 30 are lower housing members 46 of the printer portion 20. Behind the base 30 is a rear base cover 48 which includes a power adaptor unit 49 for powering the peripheral device 10. Thus, the base cover 44, rear base cover 48 and lower housing all form portions of the peripheral 10 housing.

Figure 4:
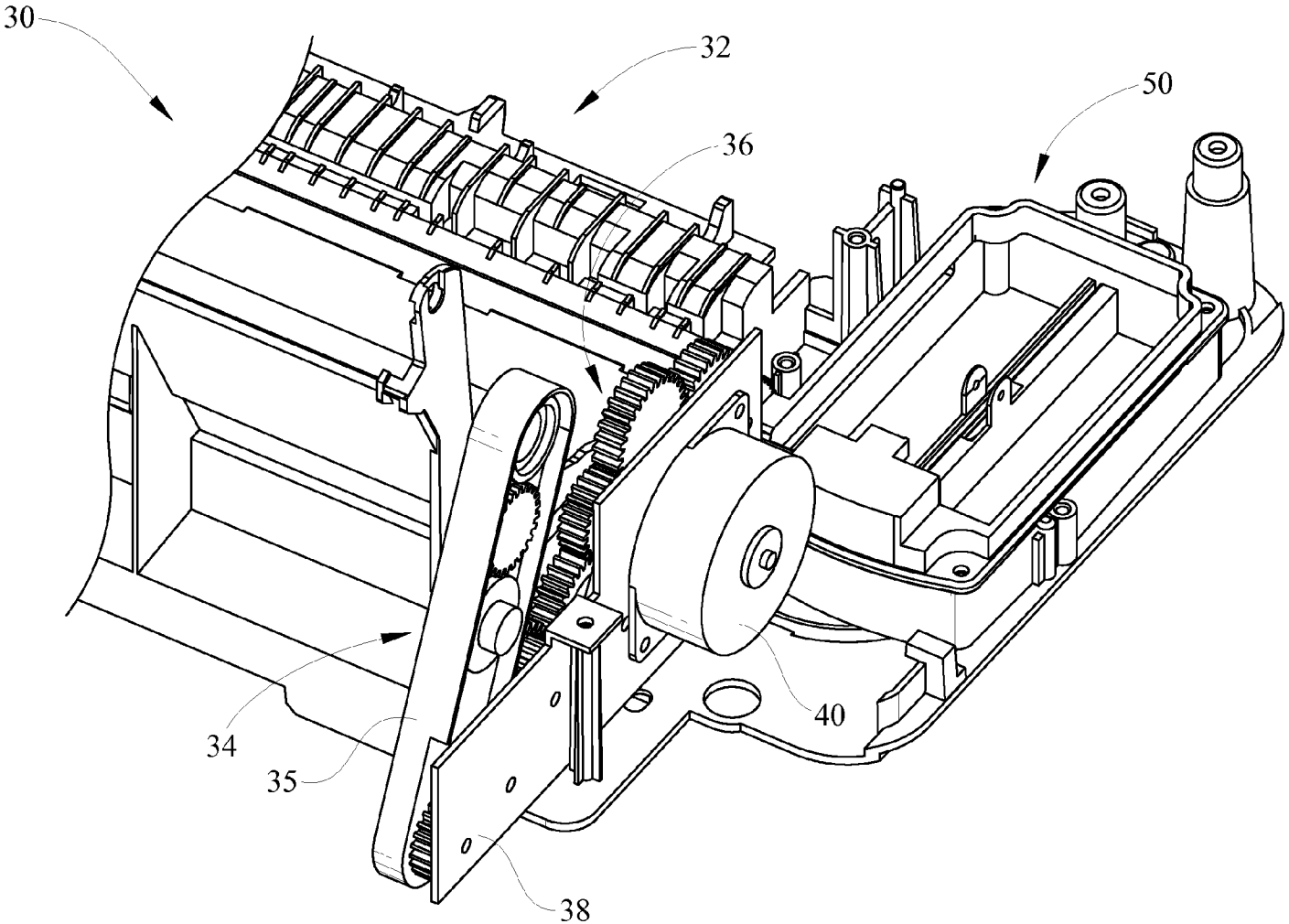
FIG. 4 is a perspective view of the motor driving the pick system and the maintenance station base.

Referring now to FIG. 4, a perspective view of the transmission for the pick system 34 and the maintenance station 50. The base 30, pick system 34 and maintenance station 50 are all depicted from the opposite side of the base shown in FIG. 3. Extending from the base 30 is a transmission 36 comprising a transmission wall 38 and a prime mover or motor 40. The motor 40 may be a bi-directional motor, for example, a Minebea-Matsushita motor having model number PM355-048. The motor 40 drives the pick system 34 and the maintenance station 50 and therefore should be operable in two rotational directions.

Figure 5:
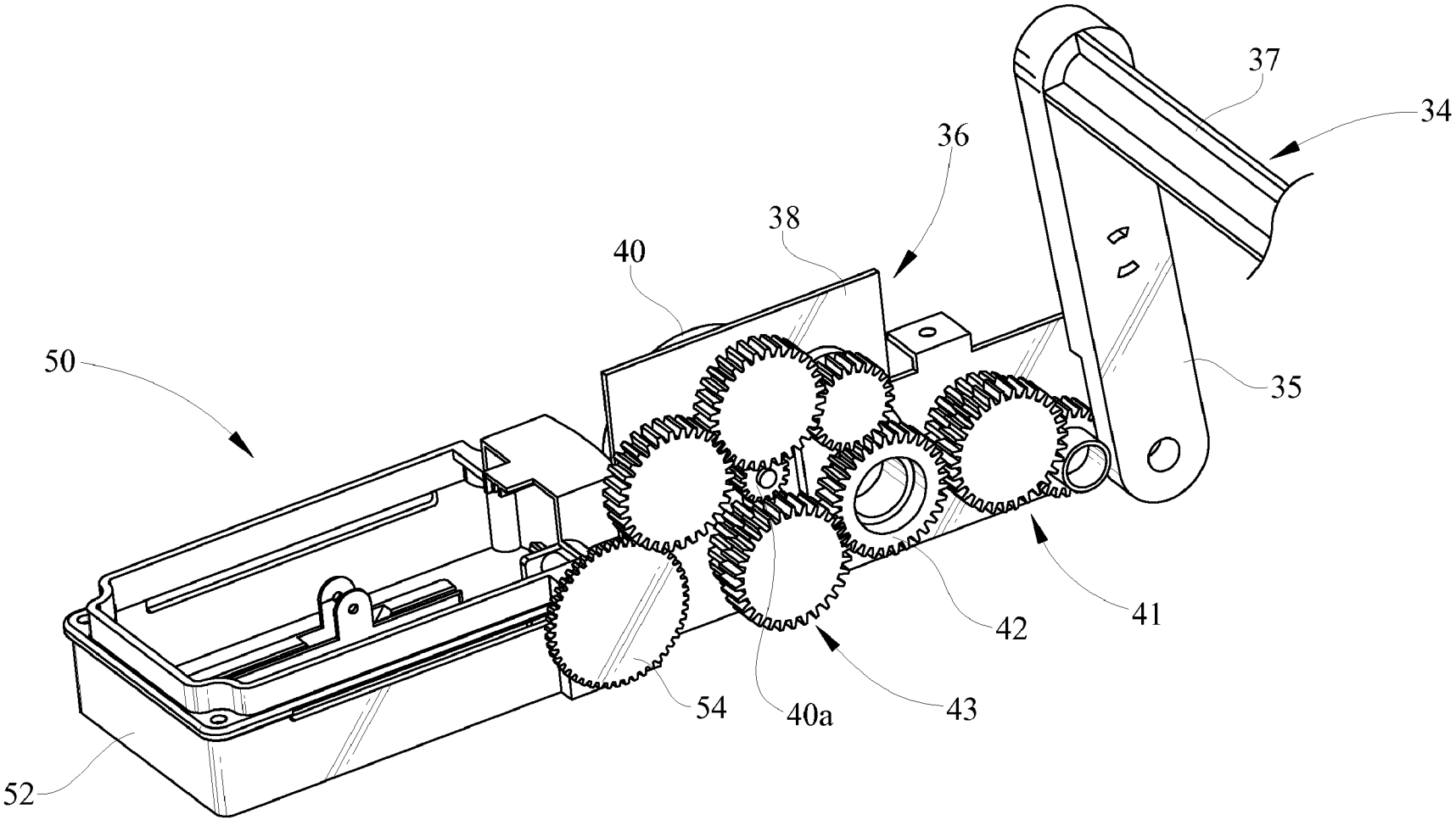
FIG. 5 is a perspective view of gear train driving the pick system and the maintenance station.

Referring to FIG. 5, the maintenance station 50, pick system 34 and the transmission 36 are depicted from the opposite side shown in FIG. 4. The figure depicts the maintenance station 50 and center feed pick system 34 engaging the transmission 36. The pick system 34 includes an auto-compensating arm 35 and a pick roller 37. The motor 40 includes a shaft with a pinion gear **40*a* which drives a pick system gear train 41 and a maintenance station gear train 43. The maintenance station gear train 43 and pick system gear train 41 are separated by a clutch 42. The clutch 42 operates so that when the motor 40 turns in a first direction, the pick system 34 is driven. When the motor 40 turns in the second opposite direction, the maintenance station 50 is driven. The pick system gear train 41 receives input from rotation of the clutch 42 in a first direction which drives gears positioned within an auto-compensating arm 35. Auto-compensating mechanisms are known to one skilled in the art and therefore are only described generally. The gears within the arm 35 are clearly shown in FIG. 4 and cause rotation of the roller 37, shown in FIG. 5. During rotation of the clutch 42 in the first direction, the arm 35 and roller 37 are caused to pivot at the connection to the transmission wall 38 such that the roller 37 rotates and the arm 35 pivots toward the media stack in the tray 22. This causes the uppermost sheet in the media tray 22 to be picked and fed into the media path 21 (FIG. 2). On the opposite side of the clutch 42, toward a maintenance base 52, rotation of the maintenance station gear train 43 is caused by rotation of motor 40 in the second opposite direction. The maintenance station gear train 43 causes rotation of the maintenance drive gear 54**, which is extending from the base and pivotally connected thereto. One skilled in the art will realize that alternative transmission designs may be utilized.

Figure 6:
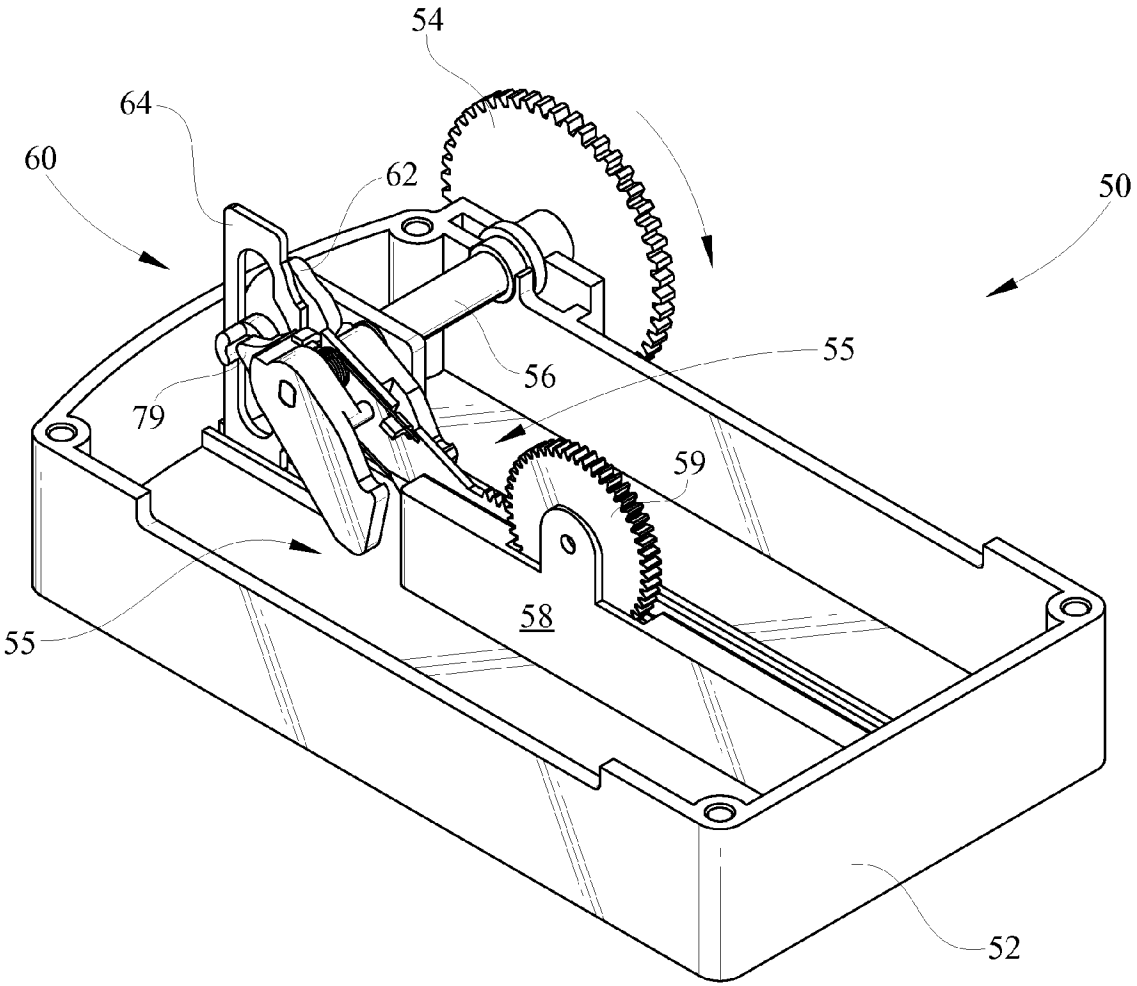
FIG. 6 is a perspective view of the maintenance station base including sled drive system.

Referring now to FIG. 6, a perspective view of the maintenance station base 52 including sled driving system or assembly 60 is depicted. The maintenance station base 52 is generally rectangular in shape with side walls extending upwardly to define a volume therein. The maintenance system drive gear 54 is connected to a shaft 56 which extends through the side wall of the maintenance station base 52. A bearing or bushing may be utilized to provide the rotational positioning of the shaft 56 within the side wall of the base 52 so that rotation of the maintenance station gear train 43, which is caused by a second rotation direction of motor 40, in turn causes rotation of the gear 54 and shaft 56. Rotation of the shaft 56 drives a sled drive system 60 which is best shown in reference to FIG. 7. Opposite the maintenance station drive gear 54, along the shaft 56, is an input cam 62. The cam 62 drives the sled drive system 60, which allows operation of the maintenance station 50.

Also depicted on two sides of a longitudinal axis of the base 52 are clearing areas or spittoons 55. The spittoons 55 are generally open areas within the volume of the base 52 and clear of moving parts wherein ink may be cleared from the print cartridges 28 above. The spittoons collect cleared ink from the cartridges 28 and provide a location where the ink can dry without negatively impacting print quality and printer performance. One skilled in the art will understand that such clearing or spitting process should not occur in an area where media moves, such as the feedpath 21, since the cleared ink may contaminate media moving through such area. Accordingly, the spittoon 55 is integrated in the maintenance area for such clearing process.

Figure 7:
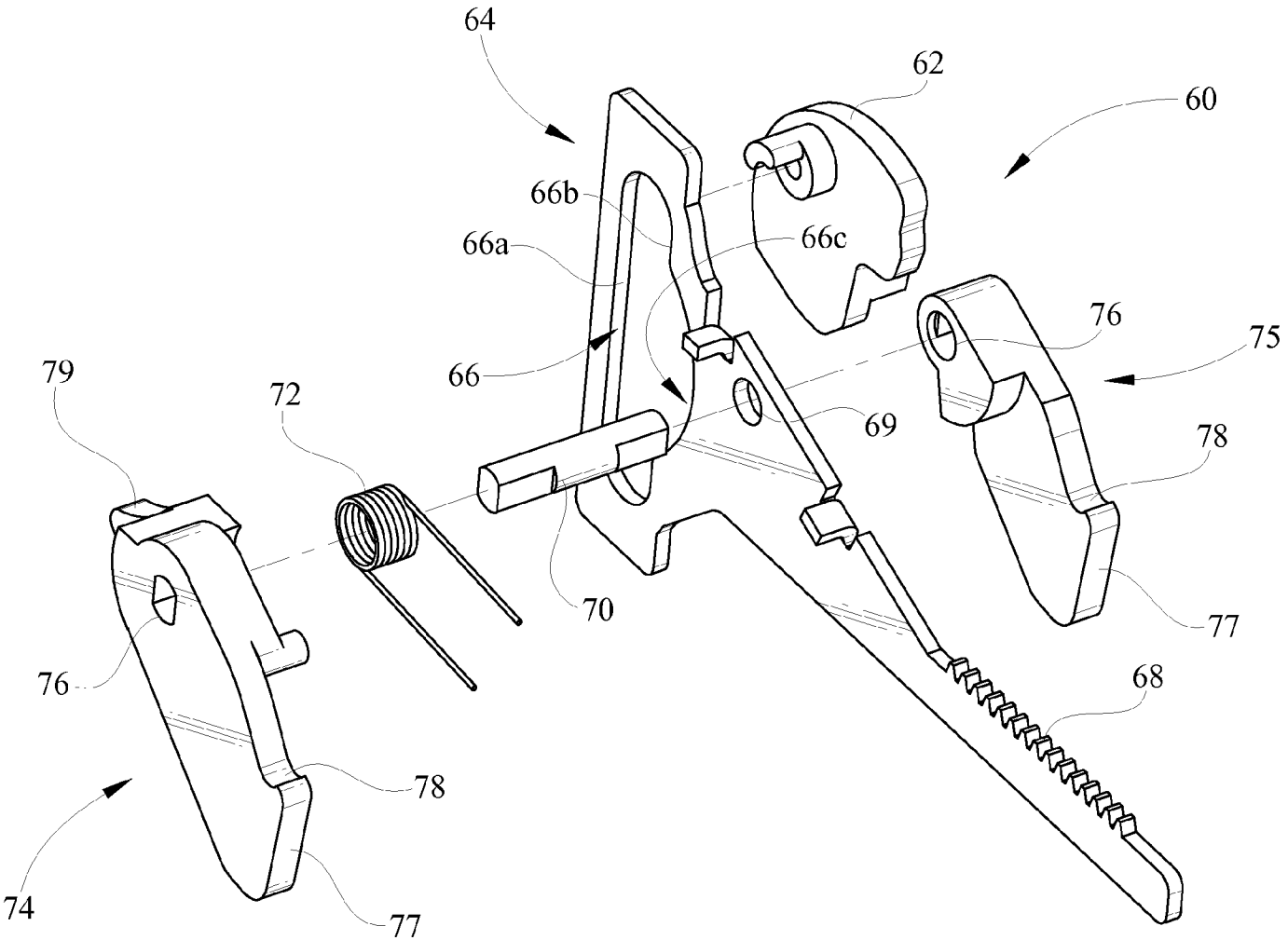
FIG. 7 is an exploded perspective view of a portion of the sled drive system.
Figure 8:
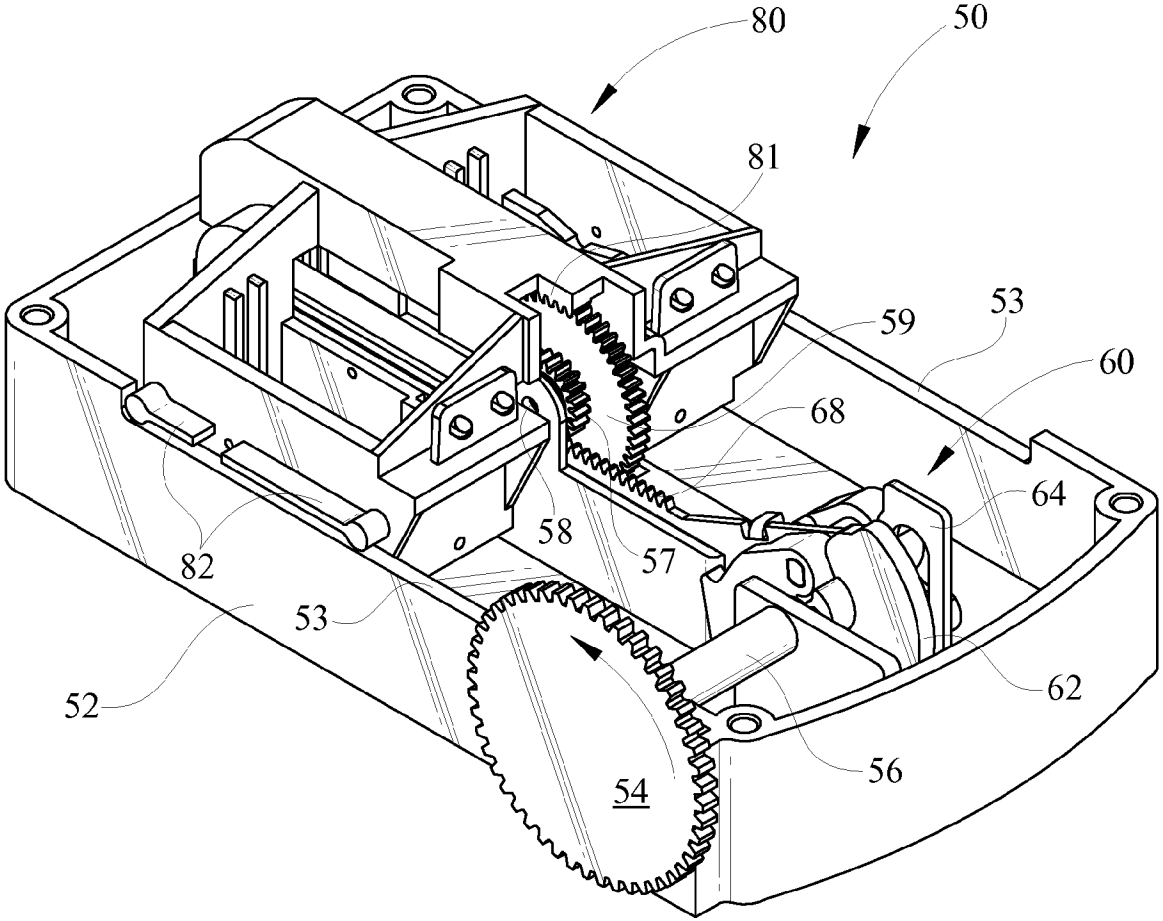
FIG. 8 is a perspective view of the maintenance station base and sled disposed in a first position for printhead capping.

Referring now to FIG. 7, an exploded perspective view of the sled drive system 60 is depicted. The cam 62 provides rotational input to a base rack 64 which is slidably positioned within base 52 and adjacent the pivot 58. The base rack 64 comprises an opening 66, which acts as a follower and receives a corresponding portion of cam 62 causing motion of the base rack 64. The rotation of the cam 62 is converted to linear motion of the base rack 64 within the maintenance station base 52. Along the base rack 64, opposite the follower 66, is a rack 68 comprising teeth which engage a pinion 57 (FIG. 8) connected to the rack gear 59 (FIGS. 6 and 8). As the base rack 64 moves linearly, the rack 68 engages the pinion 57 to rotate rack gear 59 at a pivot 58. Between the follower 66 and rack 68 is a shaft opening 69 which receives a pivot shaft 70. Extending over the pivot shaft 70 is a biasing element 72. As indicated in the exemplary embodiment, the biasing element 72 is exemplified by a torsion spring having an opening with a diameter allowing positioning of the biasing element 72 over the pivot shaft 70. One end of the biasing element 72 engages the base rack 64. The other end of the biasing element 72 engages at least one cam cap lift (as illustrated mono-cam cap lift 74). The at least one cam cap lift is depicted as one mono-cam cap lift 74 and one color-cam cap lift 75. It should be understood that the biasing element 72 engages one of the lifts 74, 75 causing movement in both of the lifts 74, 75. However, it is well within the scope of the present embodiment that the mono-cam cap lift 74 and color-cam cap lift 75 each have a biasing element and be able to move independently of the other. The pivot shaft 70 includes key seats engaging keys disposed within openings 76 of each cap lift 74, 75. Alternatively, set screws or other torque converting structures may be utilized to connect the shaft 70 to the lifts 74, 75. Accordingly, the pivot shaft 70 may rotate from the biasing force of element 72 within the shaft opening 69 so that cap lifts 74, 75 rotate relative to the base rack 64. Each of the lifts 74, 75 further comprise ramps 77 and lift cups 78. One, or both, of the mono-cam cap lift 74 and color-cam cap lift 75 comprise a cam arm 79 which engages the cam 62 at a preselected position during the rotation of the cam 62. During such engagement, the cam cap lifts 74, 75 are urged upwardly against the force of biasing element 72 causing rotation of the cam cap lifts 74, 75 relative to the base rack 64.

As previously indicated, and with reference to FIGS. 6 and 7, rotation of the maintenance drive gear 54 causes operation of the maintenance station 50. Such rotation transmits rotation of the drive shaft 56 to the cam 62. Rotation of the cam in a clockwise direction within the follower opening 66 causes engagement of the cam 62 at certain positions within the follower 66 thereby causing linear translational movement of the base rack 64. The cam 62 engages a vertical wall 66*a* causing motion of the follower opening 66, and base rack 64, away from the rack gear 59, rotatably connected to the maintenance station base 52 at the pivot 58. As the cam 62 rotates, the cam 62 engages a second vertically oriented wall 66*b* of the follower opening 66. This causes the base rack 64 to move in the opposite direction such that the follower opening 66 moves toward the rack gear 59 within the maintenance station base 52. When the cam 62 clears the second vertical wall 66*b*, the cam 62 enters a radiused portion 66*c* of the follower 66 which equals the radius of the cam 62 motion such that the base rack 64 is stationary. As this cam 62 movement continues, the cam 62 engages the cam arm 79 of one of the cam cap lifts 74, 75. Such motion provides a force on the lifts 74, 75 causing the lifts 74, 75 to pivot against the biasing element 72 and relative to the base rack 64. As a result, a lift cup 78 on each cam cap lift 74, 75, moves substantially vertically through an arc from a lower position to an upper position against the biasing force of element 72. As the cam 62 continues rotating through the radiused portion 66*c* of the follower 66, the cam 62 clears the cam arm 79. As the cam 62 clears the cam arm 79, the biasing element 72 causes the cam cap lifts 74, 75 to return to their normally disposed downward positions relative to the base rack 64. Next, the cam 62 engages the first vertical wall 66*a* causing the base rack 64 to move in the opposite direction as the previous move such that the follower opening 66 moves away from the rack gear 59. The process continues with further rotation of the maintenance station drive gear 54 and cam 62. It should be understood that the movement of the base rack 64 is north-south movement (Y-direction of FIG. 2) transverse to the media feed direction, which is east-west movement (X-direction of FIG. 2).

Referring now to FIG. 8, a perspective view of the maintenance station 50 is depicted from the opposite side of that shown in FIG. 6. The maintenance station 50 is further shown with a maintenance sled 80, hereinafter referred to simply as sled 80, thereon which moves relative to the maintenance station base 52 due to the movement of base rack 64. The rotation of maintenance drive gear 54 causes cam 62 rotation and linear motion of base rack 64. The linear motion of the base rack 64 is transferred to rotary motion at the rack gear 59 by use of the rack 68 engaging the pinion gear 57. The rack gear 59 and the pinion gear 57 are coaxially mounted at pivot 58. The sled 80 includes a sled rack 81 which engages the rack gear 59 converting the rotary motion of the rack gear 59 to linear motion of sled 80 so that the sled 80 moves linearly within the maintenance station base 52. The base rack 64 and sled 80 move oppositely during operation. The base 52 comprises guide portions 53 in the side wall thereof wherein fingers 82, extending from the sled 80, are positioned to allow guided movement of the sled 80 within the base 52. The pinion gear 57 and rack gear 59 are sized such that the rack gear 59 drives the sled 80 in a linear motion at a speed about 2½ times that of the base rack 64 and in the opposite direction of movement of the base rack 64. One skilled in the art will recognize that this speed parameter may be varied. In the depicted embodiment, the sled 80 is at one extreme end of its linear motion relative to the base rack 64 within the base 52 in the spitting position.

Figure 9A:
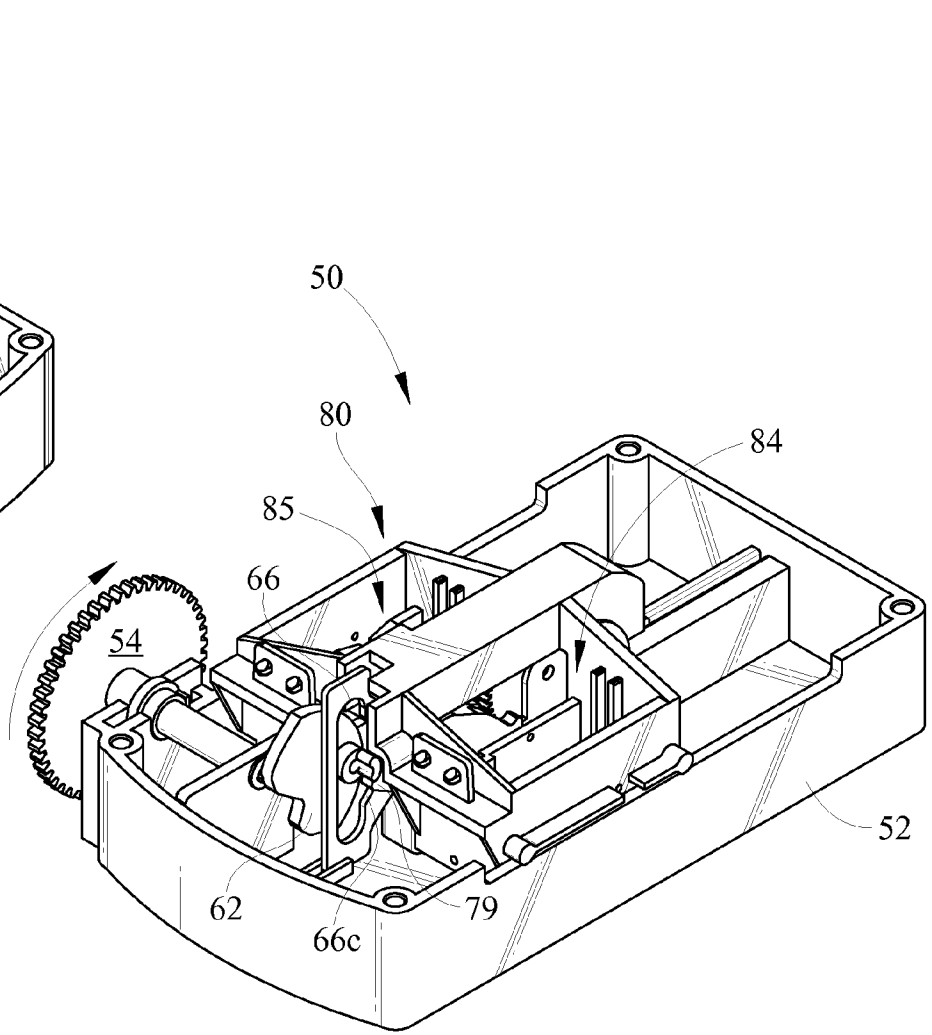
FIG. 9A is a perspective view FIG. 9 from an opposite side.
Figure 9:
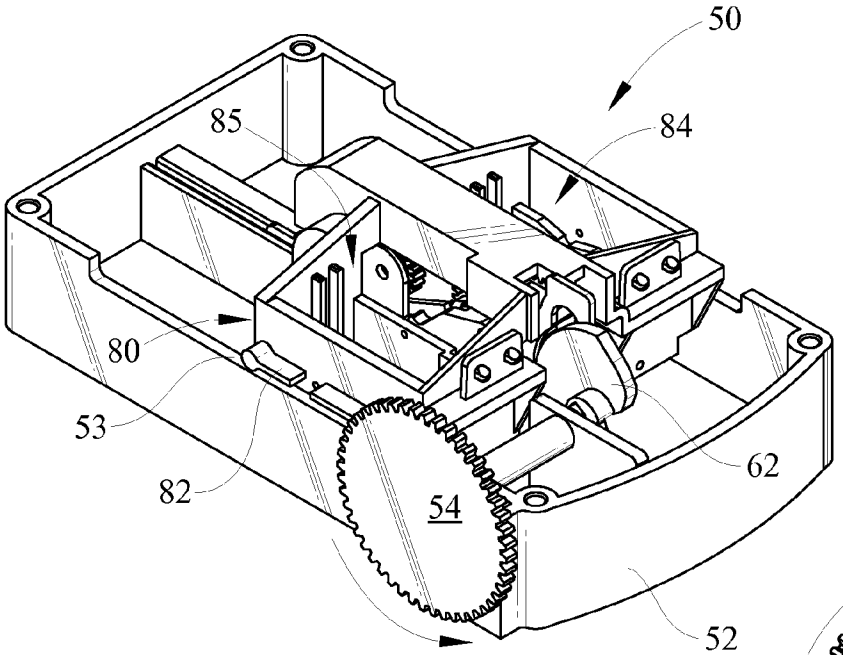
FIG. 9 is a perspective view of the maintenance station base and sled of FIG. 8 disposed in a second position for printhead capping.

Referring now to FIG. 9, a perspective view of the maintenance station base 52 and sled 80 is shown in the capping position opposite to FIG. 8. In addition, FIG. 9A shows the maintenance station 50 from the opposite side of that depicted in FIG. 9. FIGS. 9 and 9A show the sled 80 positioned closest to the maintenance station drive gear 54 when the cam 62 is positioned within the follower opening 66 and specifically within the radiused portion 66*c*. The sled 80 is stationary in this location as the cam 62 rotates through the radiused portion 66*c* because the radiused portion 66*c* matches the radius of the cam 62 rotation. In this position, the cam 62 is also shown engaging the cam arm 79, which causes lifting of the lifts 74, 75 beneath openings 84, 85 of the sled 80.

Figure 10:
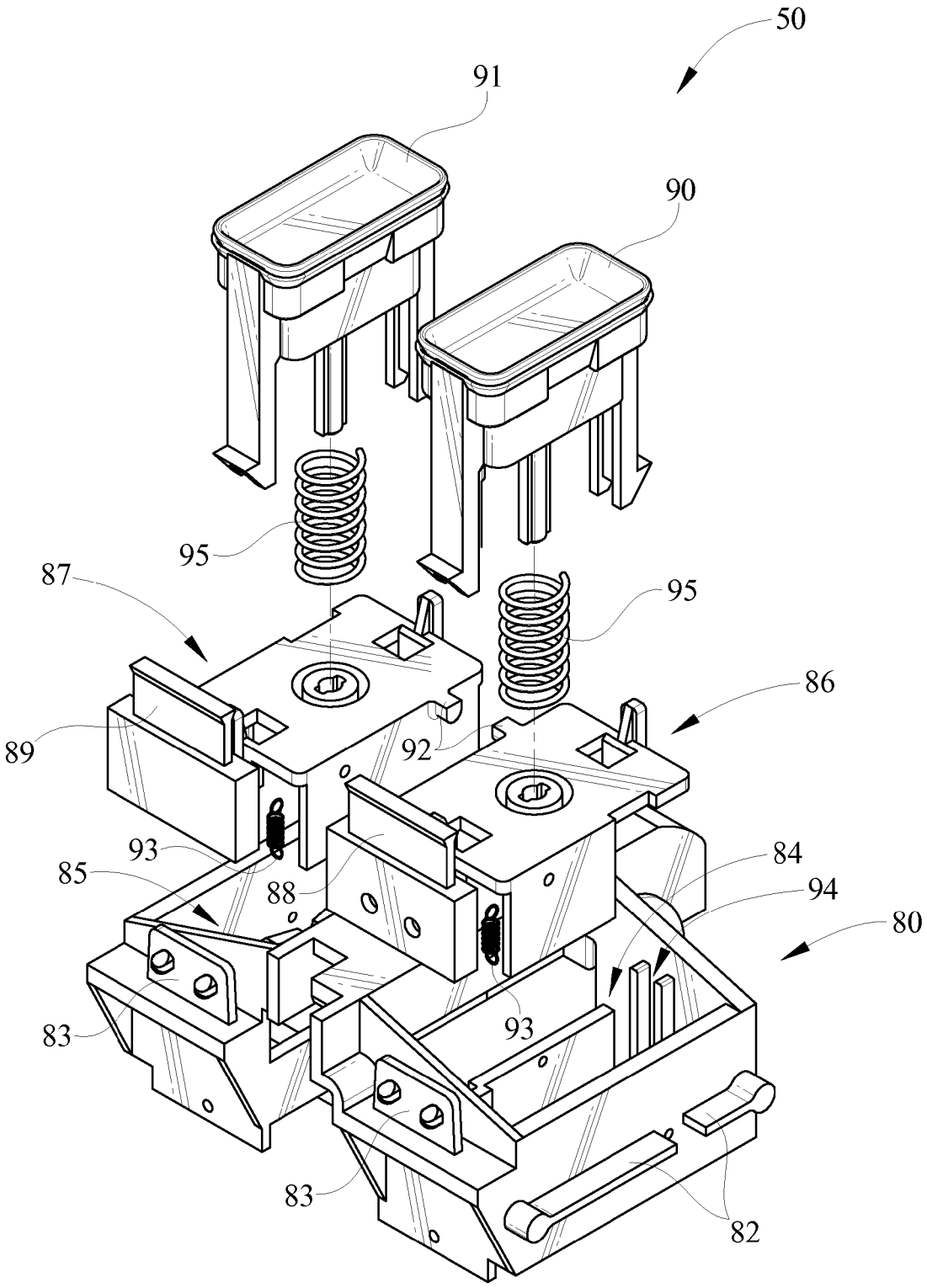
FIG. 10 is an exploded perspective view of the sled, wipers and caps used with the maintenance station.

Referring now to FIG. 10, an exploded perspective view of the sled 80 is shown with wipers 88, 89 and caps 90, 91 used for maintaining a printhead in the maintenance station 50. The sled 80, previously described, include fingers 82 extending from the sides of the sled 80 to engage the base 52 of the maintenance station 50. The sled 80 further comprises upper openings 84, 85 corresponding to the mono-cam cap lift 74 and color-cam cap lift 75. Lifts 86, 87 are nested within the openings 84, 85, respectively and receive input from the cam cap lifts 74, 75 to raise the caps 90, 91. The capping assembly is generally defined by the cam cap lifts 74, 75, the lifts 86, 87 and the caps 90, 91. Within the sled openings 84, 85 are vertically extending guides 94 which allow the vertical motion of lifts 86, 87. The guides 94 receive a complimentary part (not shown) from the lifts 86, 87 but other structure shapes may be utilized to limit the lifts 86, 87 to a single degree of freedom. Adjacent to the openings 84, 85 are vertically extending tongues 83 which receive wipers 88, 89. The tongues 83 and wipers 88, 89 define wiping assemblies which function to clean the orifice plate of the printheads on cartridges 28 after the spitting process. The wipers 88, 89 are flexible members and may facilitate acoustical dampening in the maintenance area. The wipers 88, 89 each include a lower main body and an upper elastic portion wherein the lower main body engages the tongue 83. Specifically, the lower main body may include a recess or cavity where the tongue 83 is received in a frictional engagement or fastened thereto. The wipers 88, 89 may be formed of an elastomer such as a thermoplastic polyurethane material. Beneath the lifts 86, 87 are biasing elements 93 which are connected at one end to each of the lifts 86, 87 and at the opposite end the elements 93 are connected to the sled 80 to bias the lifts 86, 87 toward the sled 80 and within the openings 84, 85, respectively.

Above the lifts 86, 87 and slidably disposed therein are caps 90, 91. The lifts 86, 87 and caps 90, 91 define capping assemblies wherein the caps 90, 91 are sized to fit over the printheads. The caps 90, 91 prevent drying of the ink within the printhead, which decreases print quality. Legs depend from the caps 90, 91 through the lifts 86, 87. Disposed between the lifts 86, 87 are biasing springs 95 to bias the caps 90, 91 and provide positive engagement between the caps 90, 91 and the printheads of cartridges 28. The biasing elements 93, 95 in the depicted embodiment are tension and compression coil springs but it may be within the scope of the present embodiment to utilize other alternative biasing devices.

As the sled 80 moves within the base 52, the wipers 88, 89 engage the printheads of the cartridges 28 (FIG. 3). Further, once the wiping portion of the maintenance occurs, the sled 80 is positioned within the base 52 such that the mono-cam cap lift 74 and color-cam cap lift 75 cause lifting of the lifts 86, 87. The lifting occurs as the lift cups 78 engage the corresponding lift arms 92 to raise the lifts 86, 87 against the biasing force of the biasing elements 93.

Figure 11:
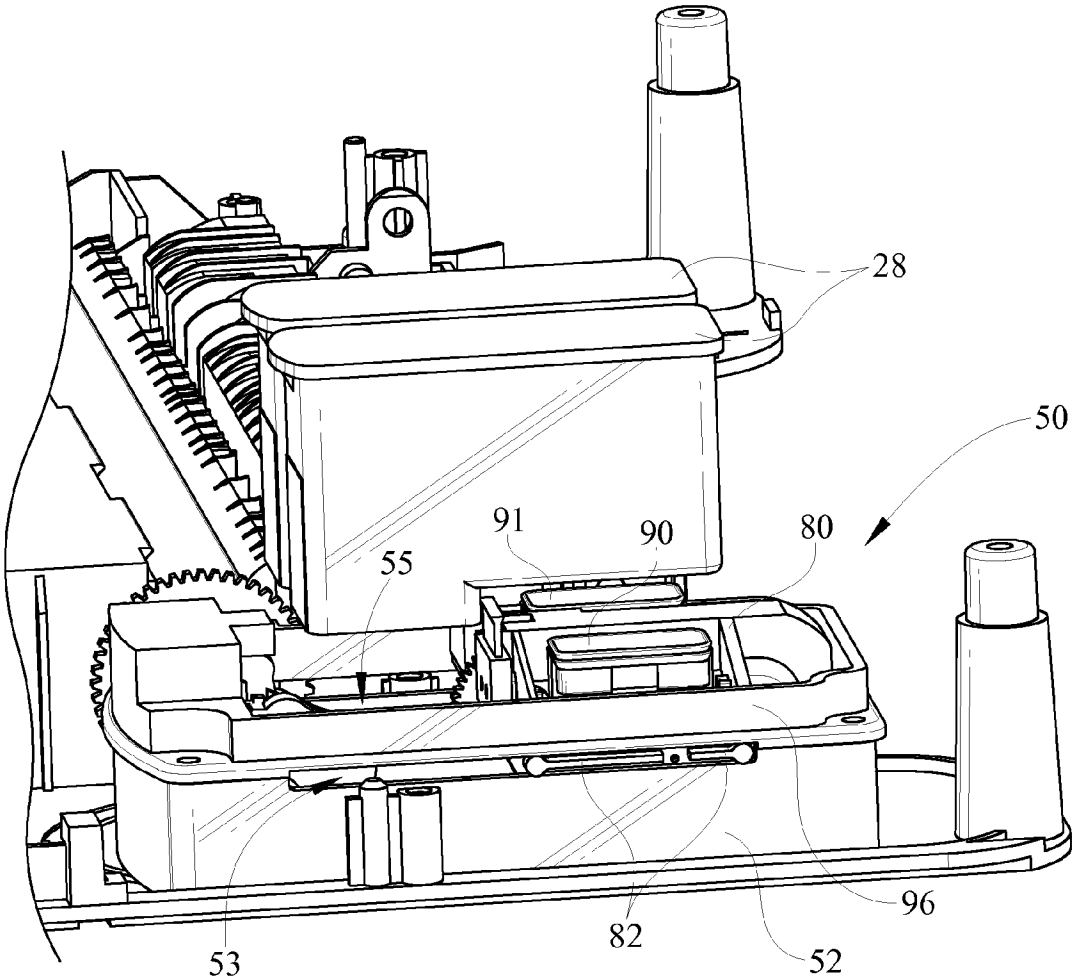
FIG. 11 is a side perspective view of the printhead positioned above the maintenance station and the sled positioned for spitting; and, FIG. 12 is a side perspective of FIG. 11 with the sled moved to a second position for wiping and capping of the printhead.
Figure 12:
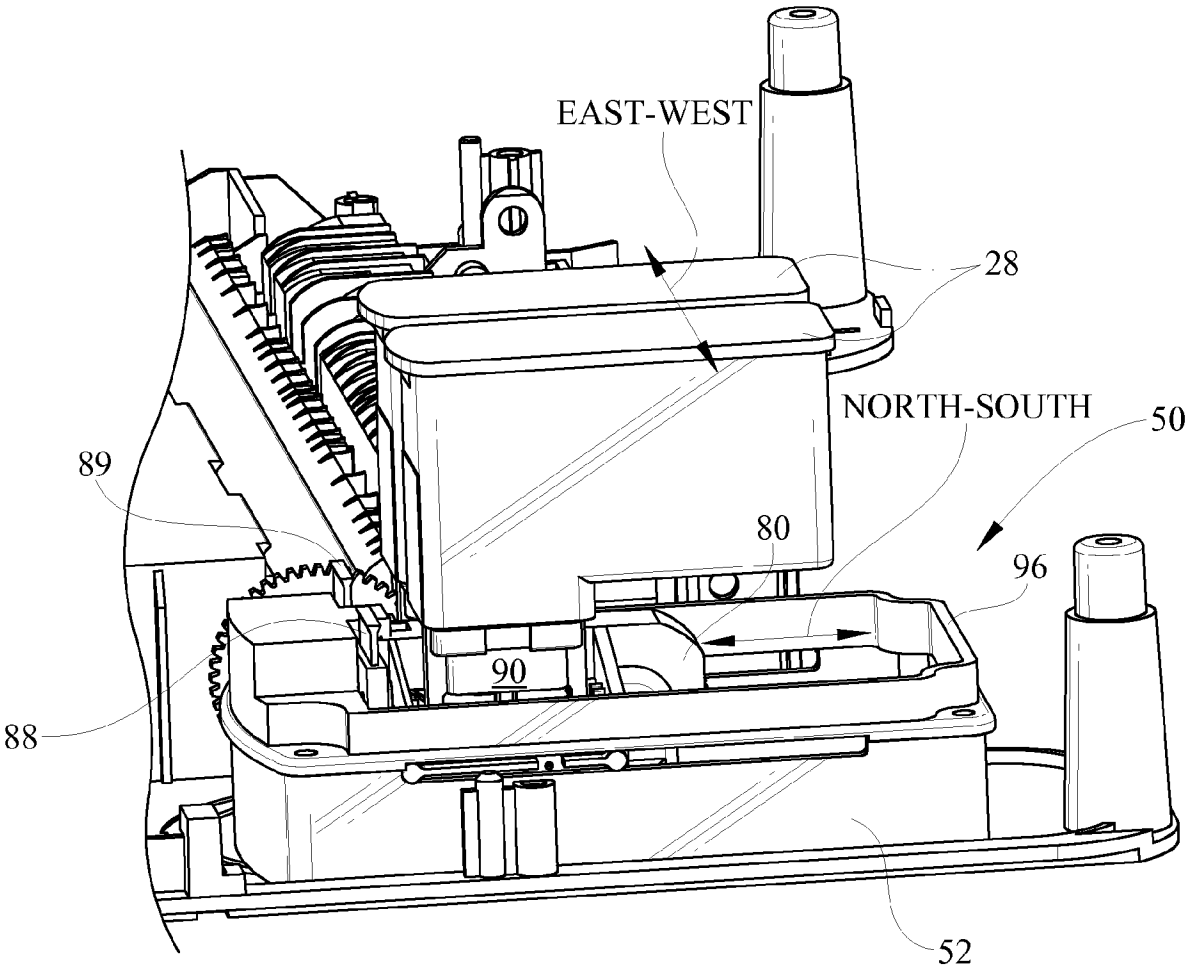

The operation of the device is shown in FIGS. 11 and 12. Referring to FIG. 11 first, the print carriage (removed for clarity) and print cartridges 28 are depicted in a home position at the maintenance station 50 and above the maintenance base 52. Relative to the base 52, the sled 80 is moved to the right-hand side and not directly beneath the print cartridges 28. At the right-hand side of the base 52, the sled 80 is clear of the spittoon portion 55 of the base 52 beneath the print cartridges 28. The spittoon 55 is formed within the base 52 for pooling ink therein which ultimately dries and does not interfere with the moving components of the maintenance station 50. In this position, the color and monochrome cartridges 28 may clear or spit ink from the printhead orifice plate during a maintenance process.

Also depicted in FIG. 11 is a maintenance base cover 96 which is connected to the maintenance base 52. The maintenance base cover 96 includes rail trapping fingers 82 in the guide 53. These define the track for linear movement of the sled 80. However, alternative structures are envisioned as within the scope of the present embodiment for limiting the sled 80 to a single degree of freedom along the north-south Y-axis.

Referring to FIG. 12, the motor 40 (FIG. 4) reverses to rotate in a second direction providing mechanical input to the maintenance station 50. As a result, the base rack 64 moves toward the sled position depicted in FIG. 11 and the sled 80 moves oppositely toward the position depicted in FIG. 12. During the movement toward the left side of the base 52, the wipers 88, 89 each engage a print cartridge 28. Thus, the movement of the sled 80 causes a wiping motion in a north-south orientation, as opposed to the east-west movement of the cartridges 28.

With further reference to FIGS. 6, 7 and 10, as the wipers 88, 89 move toward and past the cartridges 28, the color cam cap lift 74 and monochrome cam cap lift 75 move with the base rack 64 in the opposite direction. During the motion of the base rack 64 toward the right-hand side of this base 52, the ramp portions 77 of the cam cap lifts 74, 75 engage the lift arms 92 of the lifts 86, 87. The lifts 86, 87 may rise slightly due to the angle of the ramps 77 until the lift arms 92 are positioned within the lift cups 78 of the monochrome and color cam cap lifts 74, 75. At this position, the sled 80 is stationary as the cam 62 begins moving through the radiused portion 66*c* of the follower opening 66. The cam 62 engages the cam arm 79 causing lifting of the cam cap lifts 74, 75 as well as the lifts 86, 87. As a result, the caps 90, 91 are also lifted from a position directly beneath each printhead to an upper position against the printheads so as to cap the printheads of the cartridges 28 and inhibit drying of ink within the orifice plate.

The maintenance station 50 may also utilize a position sensing limiting switch (not shown) at one or more locations in order to locate the sled 80 position. For example, according to one embodiment a position sensing limiting switch may be positioned on the cam wheel 62 in order to locate the position of the sled 80. Alternatively, a sensor may be positioned on the sled 80 to detect motion relative to the base 52, in order to detect position of the sled 80 for spitting, wiping and capping. One skilled in the art will realize that various components maybe utilized to determine location of the sled 50, wipers 88, 89 and caps 90, 91.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A printhead maintenance station for a printer having a print carriage movable along a first axis including at least one print cartridge, said print cartridge having a printhead, comprising:

a printhead maintenance sled movable along a second axis perpendicular to said first axis, said sled having a sled rack;

a lifting assembly having a cap which may be moved from said sled along a third axis, said third axis perpendicular to said first and said second axes;

a wiping assembly attached to said sled and movable along said second axis;

a sled drive assembly driving said sled, said lifting assembly and said wiping assembly, said sled drive assembly comprising a base rack and a pinion gear engaging said base rack wherein said base rack and pinion gear drive said sled along said second axis;

a sled drive gear coaxially coupled to said pinion gear, said sled drive gear having a diameter that is greater than that of said pinion gear and engaging said sled rack, wherein said base rack, said pinion gear, said sled drive gear and said sled rack drive said sled along said second axis at a speed that is faster than that of said base rack; and a motor driving a media picking assembly and said printhead maintenance station.

2. The printhead maintenance station of claim 1 further comprising a biasing element connected to said base rack.

3. The printhead maintenance station of claim 2 further comprising at least one cam cap lift biased by said biasing element.

4. The printhead maintenance station of claim 3 wherein said at least one cam cap lift is a monochrome cam cap lift and a color cam cap lift.

5. A printhead maintenance station for an ink jet printhead, comprising:

a base including a spitting zone;

a maintenance sled movable relative to said base;

a wiper assembly for cleaning a printhead orifice plate;

a capping assembly for capping the printhead orifice plate; and, a pick motor operating a paper picking assembly and said maintenance sled, said wiper assembly and said capping assembly, wherein said maintenance station converts a first rotary input motion from said pick motor to a first linear motion to provide for spitting of the printhead orifice plate, and converts said first linear motion to a second rotary motion, and said second rotary motion to a second linear motion to move said maintenance sled to provide for wiping, and capping of the printhead orifice plate.

6. The printhead maintenance station of claim 5, said printhead operating motion being transverse to a media feed direction and said maintenance sled moving in said media feed direction.

7. The printhead maintenance station of claim 5 wherein said maintenance sled is movable to reveal said spitting zone.

8. The printhead maintenance station of claim 5 wherein said printhead orifice plate moves in an east-west orientation and said maintenance sled moves in a north-south orientation.

9. The printhead maintenance station of claim 5 wherein said maintenance sled moves said wiper assembly in a direction which is perpendicular to the motion of said printhead orifice plate.

10. A print device maintenance station, comprising:

a maintenance sled; and, said maintenance sled having a capping assembly and a wiper, wherein said maintenance station converts a first rotary input motion to a first linear motion, said first linear motion to a second rotary motion, and said second rotary motion to a second linear motion to move said maintenance sled.

11. The print device maintenance station of claim 10 further comprising a cam cap lift engaging said capping assembly.

12. The print device maintenance station of claim 10 wherein said maintenance sled moves from a spitting zone to a capping zone.

13. The print device maintenance station of claim 10 wherein said maintenance sled moves along an axis which is perpendicular to an axis of movement of a print cartridge.

14. The print device maintenance station of claim 10 further comprising a media pick assembly, wherein a pick motor operates said media pick assembly and said maintenance station.

15. The print device maintenance station of claim 10 wherein said first rotary input motion causes movement of said maintenance sled and movement of said capping assembly.

16. A printhead maintenance station for a printer having a print carriage movable along a first axis including at least one print cartridge, said print cartridge having a printhead, comprising:

a printhead maintenance sled movable along a second axis perpendicular to said first axis;

a lifting assembly having a cap which may be moved from said sled along a third axis;

a wiping assembly attached to said sled and movable along said second axis;

a sled drive assembly driving said sled, said lifting assembly and said wiping assembly, said sled drive assembly comprising:

a base rack having a cam follower; and a cam engaging said cam follower;

and a motor driving a media picking assembly and said printhead maintenance station.

17. The printhead maintenance station of claim 16 further comprising a biasing element connected to said base rack.

18. The printhead maintenance station of claim 17 further comprising at least one cam cap lift biased by said biasing element.

19. The printhead maintenance station of claim 18 wherein said at least one cam cap lift is a monochrome cam cap lift and a color cam cap lift.

20. The printhead maintenance station of claim 17 further comprising a pinion gear engaging said base rack, wherein said base rack and pinion gear drive said sled along said second axis.

21. A printhead maintenance station for a printer having a print carriage movable along a first axis including at least one print cartridge, said print cartridge having a printhead, comprising:

a printhead maintenance sled movable along a second axis perpendicular to said first axis;

a lifting assembly having a cap which may be moved from said sled along a third axis;

a wiping assembly attached to said sled and movable along said second axis;

a sled drive assembly driving said sled, said lifting assembly and said wiping assembly, said sled drive assembly comprising a base rack having a cam follower; and a motor driving a cam engaging said cam follower on said base rack to operate said printhead maintenance station.

* * * * *